US008671907B2

(12) United States Patent
Mistry

(10) Patent No.: US 8,671,907 B2
(45) Date of Patent: Mar. 18, 2014

(54) SPLIT CYCLE VARIABLE CAPACITY ROTARY SPARK IGNITION ENGINE

(75) Inventor: Jiban Jyoti Mistry, Malda (IN)

(73) Assignee: Chandan Kumar Seth, Malda (IN)

( * ) Notice: Subject to any disclaimer, the term of this patent is extended or adjusted under 35 U.S.C. 154(b) by 1137 days.

(21) Appl. No.: 12/594,913

(22) PCT Filed: Apr. 8, 2008

(86) PCT No.: PCT/IN2008/000228

§ 371 (c)(1),
(2), (4) Date: Oct. 6, 2009

(87) PCT Pub. No.: WO2008/122992

PCT Pub. Date: Oct. 16, 2008

(65) Prior Publication Data

US 2010/0116241 A1 May 13, 2010

(30) Foreign Application Priority Data

Apr. 9, 2007 (IN) ..... 559/KOL/2007

(51) Int. Cl.
*F02B 53/00* (2006.01)

(52) U.S. Cl.
USPC ..... 123/204; 123/200; 123/210; 123/242; 123/245; 418/191; 418/60

(58) Field of Classification Search
USPC ..... 123/200, 204, 210, 242, 245; 418/60, 418/191
See application file for complete search history.

(56) References Cited

U.S. PATENT DOCUMENTS 3,618,189 A * 11/1971 Moncrieff ..... 407/20
3,805,746 A * 4/1974 Ishii et al. ..... 123/217

(Continued)

FOREIGN PATENT DOCUMENTS

DE 19732325 A1 * 2/1999 ..... F02B 53/02
GB 2353331 A 2/2001

(Continued)

OTHER PUBLICATIONS

Machine Translation of DE-19732325, Translated on Apr. 22, 2013.*

(Continued)

*Primary Examiner* — Thomas Denion
*Assistant Examiner* — Patrick Maines
(74) *Attorney, Agent, or Firm* — The Webb Law Firm

(57) ABSTRACT

A split-cycle variable capacity rotary spark ignition engine system having at least a first rotary configuration (C1) including repetitively volume variable working chambers [60, 61, 62] for carrying out the combustion-expansion and exhaust phases and at least a second rotary configuration (C2) including repetitively volume variable working chambers (70, 71, 72) for carrying out the intake and compression phases of a four phase engine cycle. Dividing seal means (73, 74 of C1, 75, 76 of C2) for periodically dividing each of successive working chambers into a volume enlarging leading portion and a volume contracting trailing portion. Discharge valve means for varying compression chamber capacity through discharging fraction of trapped intake gas from compression chambers. A first phase altering arrangement is provided for varying the phase relation between the first rotary configuration (C1) and the second rotary configuration (C2). A second phase altering arrangement varies phase relation between the discharge valve means and corresponding compression chambers. The first rotary configuration (C1) having variable capacity combustion chambers operatively synchronize with the variable capacity compression chambers of the second rotary configuration (C2) so that accomplish nearly full-load-like combustion environment through a substantially wide engine operating range.

7 Claims, 8 Drawing Sheets

(56) References Cited

U.S. PATENT DOCUMENTS

| | | | | | |
|---|---|---|---|---|---|
| 3,930,469 | A * | 1/1976 | Tabaczynski | 123/219 |
| 4,315,488 | A * | 2/1982 | Tadokoro et al. | 123/213 |
| 4,566,412 | A * | 1/1986 | Tadokoro et al. | 123/216 |
| 4,614,173 | A * | 9/1986 | Okimoto et al. | 123/216 |
| 4,856,370 | A * | 8/1989 | Stidworthy | 475/7 |
| 5,054,439 | A * | 10/1991 | Akagi et al. | 123/184.43 |
| 5,125,379 | A * | 6/1992 | Linville | 123/221 |
| 5,271,359 | A * | 12/1993 | Teramoto et al. | 123/216 |
| 5,596,963 | A * | 1/1997 | Lai | 123/236 |
| 6,363,907 | B1 | 4/2002 | Arai et al. | |
| 6,619,267 | B1 | 9/2003 | Pao | |
| 6,640,543 | B1 | 11/2003 | Seal | |
| 7,721,701 | B2 * | 5/2010 | Dec | 123/245 |
| 2004/0157509 | A1 * | 8/2004 | Willmot | 440/50 |
| 2007/0036667 | A1 * | 2/2007 | Sterk | 418/35 |

FOREIGN PATENT DOCUMENTS

| | | | | |
|---|---|---|---|---|
| JP | 54122492 | A * | 9/1979 | B24B 19/12 |
| JP | 57140971 | A * | 8/1982 | F16K 11/06 |
| JP | 59070837 | A * | 4/1984 | F02B 53/08 |
| JP | 62255532 | A * | 11/1987 | F02B 53/02 |
| JP | 63001719 | A * | 1/1988 | F02B 53/08 |
| JP | 01032023 | A * | 2/1989 | F02B 55/14 |
| JP | 01273832 | A * | 11/1989 | F02B 53/06 |
| JP | 06294451 | A * | 10/1994 | F16H 1/38 |
| JP | 2001115865 | | 4/2001 | |
| WO | WO 8703335 | A1 * | 6/1987 | F01L 1/34 |
| WO | 03008785 | A1 | 1/2003 | |
| WO | 2006042423 | A1 | 4/2006 | |
| WO | 2007036955 | A1 | 4/2007 | |
| WO | WO 2007036955 | A1 * | 4/2007 | B03C 1/033 |

OTHER PUBLICATIONS

Leduc et al., Downsizing of Gasoline Engine: an Efficient Way to Reduce CO2 Emissions, Oil & Gas Science and Technology—Rev. IFP, 2003, 115-127, 58-1.

Roberts, Benefits and Challenges of Variable Compression Ratio (VCR), SAE Technical Paper Series 2003-01-0398, Reprinted from New SI Engine and Component Design, 2003, SAE International.

Shiga et al., Effect of Over-Expansion Cycle in a Spark-Ignition Engine Using Late-Closing of Intake Valve and its Thermodynamic Consideration of the Mechanism, International Journal of Automotive Technology, 2001, 1-7, 2-1.

Ohkubo et al., Developed Technologies of the New Rotary Engine (Renesis), SAE Technical Paper Series 2004-01-1790, Reprinted from Advanced Powertrains, 2004, SAE International.

* cited by examiner

SPLIT CYCLE VARIABLE CAPACITY ROTARY SPARK IGNITION ENGINE

FIELD OF THE INVENTION

This invention relates to a spark ignition engine and more specifically to a split cycle rotary spark ignition engine. The present invention particularly relates to a split cycle variable capacity rotary spark ignition engine.

BACKGROUND ART

It is known that a spark ignition (SI) internal combustion (IC) engine is generally most efficient when the cylinder pressure and temperature at the end of a compression phase are closed to its maximum tolerable limit. In a conventional spark ignition engine, whether it is a rotary or a reciprocating one, this condition is achievable only when the throttle valve in the intake manifold is fully open to allow the maximum possible air or fuel-air mixture in the engine cylinder during intake phase and during following compression phase said intake air get compressed into a minimum chamber volume which is fixed by the design of the engine. During fully-open throttle condition the intake manifold pressure is near atmospheric pressure or about 1 bar. During the typical driving conditions which generally cover above 90% of the entire drive cycle, the intake manifold pressure remains about 0.5 bar or less, causing considerable drag on the driveshaft and this phenomenon is commonly known as 'pumping loss', that adversely affects the engine efficiency. Throttling further reduces chamber pressure and temperature at the end of compression phase and increase charge dilution. Hence reduces the combustion flame speed and the engine suffers from unstable combustion which leads to reduction in efficiency and increase in hazardous tailpipe emissions.

Conventionally, a mid-size car with a gasoline engine is only about 20% efficient when cruising on a level road whereas the rated peak efficiency of the car is about 33%. That is, during cruising, the Specific Fuel Consumption (SFC) of the engine is about 400 g/kWh, while under high load condition the same engine can reach a SFC of 255 g/kWh. See, P. Leduc, B. Dubar, A. Ranini and G. Monnier, "Downsizing of Gasoline Engine: an Efficient Way to Reduce $CO_2$ Emissions", Oil & Gas Science and Technology—Rev. IFP, Vol. 58 (2003), No. 1, pp. 117-118. As the engine operating condition goes below cruising mode such as the city driving conditions, the efficiency further reduces drastically. Considering this, if an engine is so downsized to operate with higher specific load during cruising or city driving condition, it could not accelerate or climb steep road well.

Ongoing research efforts, visible mostly in the reciprocating engine vicinity, indicate the future trends of improving thermodynamic efficiency of SI engine, which may also be extended to implement and to improve in case of Rotary engines as well under the same reference. Introduction of a fuel efficient Rotary engine, therefore, demands a quick review of the implementation of those efforts as being done in the field of reciprocating engines.

Throughout the past decades some interesting ideas like Variable Displacement Technology, Variable Compression Ratio Technology, Variable Valve Technology, Engine Downsizing and Pressure Boosting, Stratified Charging of Fuel, Controlled Auto Ignition, Load Dependant Octane Enhancement of Fuel have been introduced in order to attain better SI engine efficiency and various sets of combinations of these methods have also been experimented within a single engine.

In reciprocating piston engine the Variable Displacement volume of engine is generally achieved by cylinder deactivation method, wherein, during part load operation, few cylinders of a multi-cylinder engine are selectively deactivated so that not to contribute to the power and thus reducing the active displacement of the engine. Therefore, only the active cylinders consume fuel and are operated under higher specific load than that of the all cylinder operations, hence the engine attains higher fuel efficiency. The number of deactivated cylinders can be chosen in order to match the engine load, which is often referred to as "displacement on demand". As pistons of both of the active and deactivated cylinders are generally connected to a common crankshaft, the deactivated pistons continue to reciprocate within the respective cylinders resulting in undesired friction. The valves of the deactivated cylinders need specialized controls, which produce further complications. Moreover, the deactivation and reactivation of cylinders take place in steps, and therefore further measures become necessary in order to make the stepped transitions smooth. Managing unbalanced cooling and vibration of variable-displacement engines are other designing challenges for this method. In most instances, cylinder deactivation is applied to relatively large displacement engines that are particularly inefficient at light load.

Modern electronic engine control systems are configured to electronically control various components such as throttle valves, spark timing, intake-exhaust valves etc. in order to smoothing of the transition steps of a variable displacement IC engine. An example of electronic throttle control method is to be found in U.S. Pat. No. 6,619,267 (Pao), describing the intake flow control scheme to manage the transition steps. A variable displacement system for both the reciprocating piston and rotary IC engines is disclosed in U.S. Pat. No. 6,640,543 (Seal) that includes a turbocharger to enhance the working efficiency.

A control system for a variable displacement internal combustion engine is to be found in JP2001115865 A (Arai Masahiro, Nagaishi Hatsuo) describing determination of effective flow cross sectional area in response to a throttle position. The effective flow cross sectional area is used to determine a volumetric airflow ratio. A control unit determines deactivation and reactivation of some of engine cylinders and varying strokes in a cycle. The control unit modifies the predetermined function in response to the number of cylinders being activated and the number of strokes in a current cycle. A rotary variable displacement volume engine is disclosed in WO 2006/042423 A1 (Pekau), wherein a rotary engine having a toroidal cylinder within which a set of pistons rotatable unidirectionally and coaxially about a driveshaft. A rotating disk valve with a partially cutoff portion sequentially intercept the toroidal cylinder to realize a compression phase when a piston is approaching the disc valve and an expansion phase when a piston is getting further from the disc valve. The cutoff portion of the rotating disk valve synchronizingly provides an opening so that at the end of compression the piston can pass the disk valve area. On the passing of the piston, said disc valve closes the toroidal cylindrical path in order to form an expansion chamber between the disc valve and the piston just passed the disc valve. A volume variable combustion chamber is fluidly connected to both compression and expansion chambers. Plurality of selectively operable intake and exhaust valves are arranged along the toroidal cylinder. Selective opening of particular intake valve or valves dictate the amount of intake air and similarly selective opening of exhaust valves dictates the expansion limit. In this engine design pumping loss could be avoided but it is very difficult to avoid a substantial loss of compressed air directly to the exhaust chamber during the opening of the disc valve. Moreover, hot gas flow from the separate combustion chamber to the expansion chamber could be led to high heat loss, over heating of duct and respective valves and seems to be very complex to control.

Like variable displacement engine technologies, the variable compression ratio (VCR) technologies also require various associated modifications such as engine downsizing, turbocharging or supercharging, variable valve technology, load dependant octane enhancement of fuel etc. to meet increasing stringent emission norms and fuel efficiency requirements. The basic VCR idea is to run an engine at higher compression ratio under part load operating conditions when a fraction of full intake capacity is consumed and at relatively lower compression ratio under heavy load conditions when the full intake capacity is consumed. Thereby the resultant cylinder pressure and temperature at the end of compression can be improved through a wide load conditions, hence, better fuel efficiency could be achieved. As VCR technology alone cannot avoid part load pumping losses, it requires assistance of Variable Valve Technology (VVT). The VVT provides the benefit of un-throttled intake to an SI engine, wherein the amount of intake gas at part load is controlled by either closing the intake valve early to stop excess intake or by late intake valve closing so that to discharge excess intake gas back to the intake manifold. The VCR technology itself, however, is quite complex to design and manufacture. See "Benefits and Challenges of Variable Compression Ratio (VCR)", Martyn Roberts, SAE Technical Paper No. 2003-01-0398.

Over expansion cycle in a SI engine can add significant benefit to its thermal efficiency. The Atkinson cycle and Miller cycle efficiency is established on the said over expansion cycle principle, see "Effect of over-expansion cycle in a spark-ignition engine using late-closing of intake valve and its thermodynamic consideration of the mechanism", S. Shiga, Y. Hirooka, Y. Miyashita, S. Yagi, H. T. C. Machacon, T. Karasawa and H. Nakamura., International Journal of Automotive Technology, Vol. 2, No. 1, pp. 1-7 (2001). The over-expansion cycle can produce substantial benefit in thermal efficiency over conventional engine cycle when being applied together with variable compression ratio and variable valve technology. But the introduction difficulties remain too high to introduce in a practicable engine.

The widely known conventional rotary IC engine, most familiar as the 'Wankel engine', has never been considered as an efficient engine because of some constraints inherent to its design, i.e. high surface to volume ratio of combustion chamber, high burning charge flow within the combustion chamber, uneven heating of the engine etc. Poor gas sealing capability and high lubricant contamination are other serious demerits of this engine. Mazda Motor Corporation of Japan continuing rigorous efforts for past few decades in order to improving the rotary engine efficiency and as a result considerable developed can be seen through various working components of the engine, such as increased intake-exhaust port area, introduction of sequential dynamic air intake system (S-DAIS), side exhaust ports for deducing exhaust gas overlapping into intake gas, reduced unburned Hydrocarbon emission, improved gas seals and combustion seals lubrication methods etc. See "Developed Technologies of the New Rotary Engine (Renesis)", Masaki, Seiji, Ritsuharu, Suguru, Hiroshi-Mazda Motor Corp., SAE Technical Paper No. 2004-01-1790.

The purpose of the present invention is to propose a split cycle variable displacement engine which has continuous and wide range of displacement volume and compression ratio variation capacity; the engine is fairly simple to design and manufacture, easy to control and can maintain nearly full-load-like combustion environment (pressure, temperature, turbulence etc.) through the entire operating range.

SUMMARY OF THE INVENTION

The prime object of the invention resides in the provision of a novel rotary SI engine system attaining high fuel efficiency by means of producing nearly full-load-like combustion chamber condition throughout the engine operating conditions. The engine system, moreover, is free from the constraints and complexities of the aforementioned methods to practice the variable displacement technology, variable valve technology (VVT) and variable compression ratio engine technologies etc.

The above mentioned benefits are accomplished in the present embodiment of the invention that including a first rotary configuration being adapted for carrying out the combustion-expansion and exhaust phases of a four-phase engine cycle and a second rotary configuration being adapted for carrying out the intake and compression phases of a four phase engine cycle. A first phase altering arrangement continuously alters the phase relation between the first and second rotary configuration in order to alter the instantaneous combustion chamber volume in synchronization with the amount of compressed gases which are compressed and delivered by the second rotary configuration to said combustion chambers of the first rotary configuration, whereas the amount of compressed gas is controlled by a second phase altering arrangement which controls a set of valves for discharging selective amount of trapped intake gases from respective compression chambers of the second rotary configuration.

Another important object of the present invention is to provide a split cycle rotary SI engine system including an un-throttled intake system for avoiding pumping loss. Due to un-throttled intake system the intake chambers always intake full capacity of intake gases, and therefore, considering the instantaneous load condition, the undesired amount of intake gases are discharged from the compression chambers through gas discharge valves. On the closing of said gas discharge valves effective compression of the remaining intake gases start. Whereas, the amount of the said discharged gases vary with variable load dependant phase relation between said gas discharge valves and corresponding compression chambers.

A further important object of the present invention resides in the provision of a novel rotary SI engine system, in which, during the substantial portion of typical driving condition the effective expansion ratio of the expansion chambers remain substantially larger than the effective compression ratio of the compression chambers while the chamber pressure at the end of the compression phases is maintained very close to full-load-like pressure.

A still further object of the present invention is to provide a split cycle variable capacity rotary spark ignition engine in which the effective compression ratio is variable through a substantially wide compression ratio by independently controlling the first phase altering arrangement and the second phase altering arrangement.

A still further object of the present invention is to provide a split cycle rotary spark ignition engine in which the first rotary configuration experiences only the hot combustion-expansion and exhaust phases through its entire working volumes and the second rotary configuration experiences only the cold intake and compression phases through its entire working volumes. Hence, each of the rotary configurations expands uniformly irrespective of each other, which results in better sealing ability and less internal stress of the castings.

A still further object of the present invention is to provide a split cycle rotary spark ignition engine in which fuel is injected into gas transfer passages, where the fuel become vaporized and mixes with compressed air and then delivered directly into combustion chambers. Therefore the chances of surface wetting and lubricant contamination are greatly reduced.

The present invention provides a split-cycle variable capacity rotary spark ignition engine which comprising: at least a first rotary configuration including plurality of repetitively volume variable working chambers adapted to carry out the combustion-expansion and exhaust phases of a four phase engine cycle; at least a second rotary configuration including plurality of repetitively volume variable working chambers adapted to carry out the intake and compression phases of a four phase engine cycle; periodic seal means for periodically dividing each of successive working chambers into a volume expanding leading portion and a volume contracting trailing portion; means for sequentially transferring compressed gases from the second rotary configuration to the first rotary configuration; means for modifying effective engine displacement by means of discharging variable fraction of trapped intake gas during compression phases; means for modifying phase relations between the first rotary configuration and the second rotary configuration.

DETAILED DESCRIPTION OF THE PREFERRED EMBODIMENT

Figure 1:
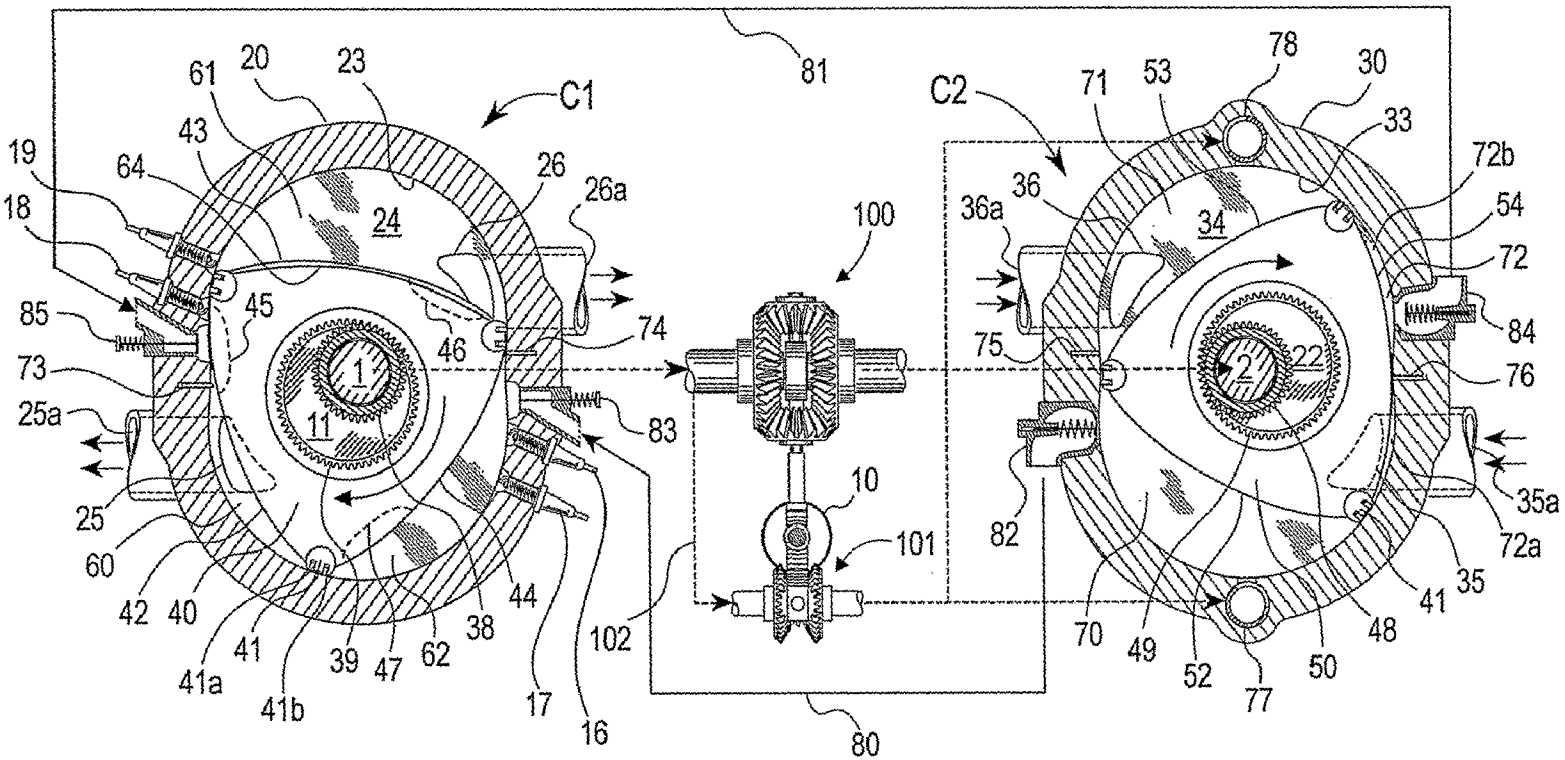
FIG. 1 is a schematic illustration of one embodiment of the invention in which a first and a second rotary configuration are shown in axial view and an phase altering arrangement interconnecting the first and second rotary configuration is shown in side view.

With reference first to FIG. 1, a split cycle rotary engine including a first rotary configuration C1 for carrying out the combustion-expansion and exhaust phases of four phase engine cycle and a second rotary configuration C2 for carrying out the intake and compression phases of four phase engine cycle (both in axial view). A first phase altering mechanism 100 operatively alters phase relation between said first rotary configuration C1 and second rotary configuration C2. The first rotary configuration Cl includes rotor housing 20 having an inner chamber defined by epitrochoidal peripheral wall 23 enclosed by two oppositely similar sidewalls 24 (only one is shown). The peripheral wall 23 is preferably a two-lobbed epitrochoid in which the lobes are joined each other by lobe junctions defining the minor axis regions of the said peripheral wall. Within the inner chamber a rotor 40 is rotatable about a lobe 11 eccentrically integrated with center shaft 1 which is rotatable about its own axis and supported coaxially on rotor housing 20. On both side of the rotor 40 internal ring gears 39 (only one is shown) are coaxially confined and engaged in meshing relation with stationary external ring gears 38 (only one is shown) coaxially confined on both the sidewalls. The second rotary configuration C2 includes rotor housing 30 having an inner chamber defined by epitrochoidal peripheral wall 33, two sidewalls 34 (only one is shown), rotor 50, internal ring gears 49, external ring gears 48 center shaft 2 with eccentric lobe 22 arranged in similar fashion as is the first rotary configuration C1. Both the rotors 40 and 50 have plurality of apex portions supporting apex seal arrangements 41 for maintaining sealing relations between the apex portions and the respective peripheral wall. The apex seal arrangements 41 are preferably swivel seal arrangements for keeping the seal elements 41a and 41b in perpendicular sealing contact with the respective peripheral walls. Side seals 64 (only one is shown) are extended between each pair of adjacent apex seal arrangements on both sides of the rotors 40 and 50. Working faces 42, 43, 44 of the rotor 40 are extended between each pair of adjacent apex seal arrangements 41. On the leading portions of working faces 42, 43, 44 of the rotor 40 recesses 45, 46, 47 are provided for improving the chamber size and shape for combustion. Repetitively volume variable working chambers 60, 61, 62 exist between peripheral wall 23, sidewalls 24 and rotor working faces 42, 43 and 44 respectively. Each of the sidewalls 24 comprise a first exhaust port 25 and a second exhaust port 26 connected to a first exhaust manifold 25*a* and a second exhaust manifold 26*a* respectively. The exhaust ports 25 and 26 are sequentially opened and closed by the motion of the respective rotor 40. Each of the sidewalls 34 comprise a first intake port 35 and a second intake port 36 connected to a first intake manifold 35*a* and a second intake manifold 36*a* respectively. The exhaust ports 25 and 26 are sequentially opened and closed by the motion of the rotor 40 and the intake ports 35 and 36 are sequentially opened and closed by the motion of the rotor 50. Periodically operative dividing seal elements 73, 74 are carried by peripheral wall 23 of the first rotary configuration C1 near minor axis regions and dividing seal elements 75, 76 are carried by peripheral wall 33 of the second rotary configuration C2 near minor axis regions for successively dividing each of the working chambers of respective housing into a volume enlarging leading portion and a volume contracting trailing portion for a predefined period of about 100 degrees of center shaft rotation (hereinafter will be referred to as crank angle degrees or CAD) during which respective working chamber experiences its minimum chamber volume (usually referred to as top dead center or TDC), wherein the division of working chambers preferably starts at least 50 CAD before top dead center (BTDC). The leading portions of the divided working chambers of the first rotary configuration C1 are used as effective combustion chambers. Two combustion chamber regions are present where two successive combustion events take place in one revolution of center shafts. Sparkplugs 16, 17 and 18, 19 are mounted in proximity of said combustion chamber regions accordingly. During the period of division of working chambers, the effective combustion chamber volumes continuously expand through a minimum combustion chamber volume and a maximum combustion chamber volume. Each of the seal elements 73, 74 of the first rotary configuration C1 and 75, 76 of the second rotary configuration C2 are preferably operated by cam means (not shown). The rotor working faces 52, 53 and 54 of rotor 50 are adjacent to working chambers 70, 71 and leading portion 72*a* and trailing portion 72*b* of divided working chamber 72 respectively. Inlet check valves 82 and 84 of the second rotary configuration C2 alternately permit one way flow of compressed air to corresponding gas passages (schematically shown by phantom line 80 and 81) in synchronization with the corresponding outlet control valve arrangements 83 and 85 to permit one way flow of compressed gas from said gas passages 80, 81 to corresponding combustion chambers of the first rotary configuration Cl. Start of opening of the outlet control valves 83 and 85 is arranged to coincide with the start of division of respective working chambers.

Intake ports 35 and 36 are positioned on the sidewalls 34 of the second rotary configuration C2. The intake ports 35 and 36 are sequentially opened and closed by the motion of the respective rotor 50. The intake ports 35 and 36 are connected to the intake manifolds 35*a* and 36*a* respectively. The engine has throttle less intake system, so the intake chambers always consume the full capacity of intake gas during intake phases. Therefore, considering the instantaneous load condition, the undesired amount of trapped intake gas is discharged during the early stage of compression phases by opening gas discharge valves 77, 78 which are preferably rotary valves and each has 180 CAD of opening duration in every turn. The effective compression of intake gases start on the closing of the gas discharge valves.

The phase altering arrangement includes a first phase altering mechanism 100 and a second phase altering mechanism 101 and a motor 10 for driving both of the phase altering mechanisms 100 and 101 simultaneously. The first phase altering mechanism 100 continuously alters the phase relation between the first rotary configuration C1 and the second rotary configuration C2. The second phase altering mechanism 101 alters the phase relation between gas discharge valves 77, 78 and corresponding working chambers of the second rotary configuration C2 for control the amount of trapped intake gas to be discharged. Therefore, through the synchronized agreement between the first phase altering mechanism 100 and the second phase altering mechanism 101 the instantaneous combustion chamber volumes match such with the amount of compressed gases which are delivered by the corresponding compression chambers that nearly full-load-like combustion chamber pressure is attainable through substantially wide engine operating condition.

Figure 3:
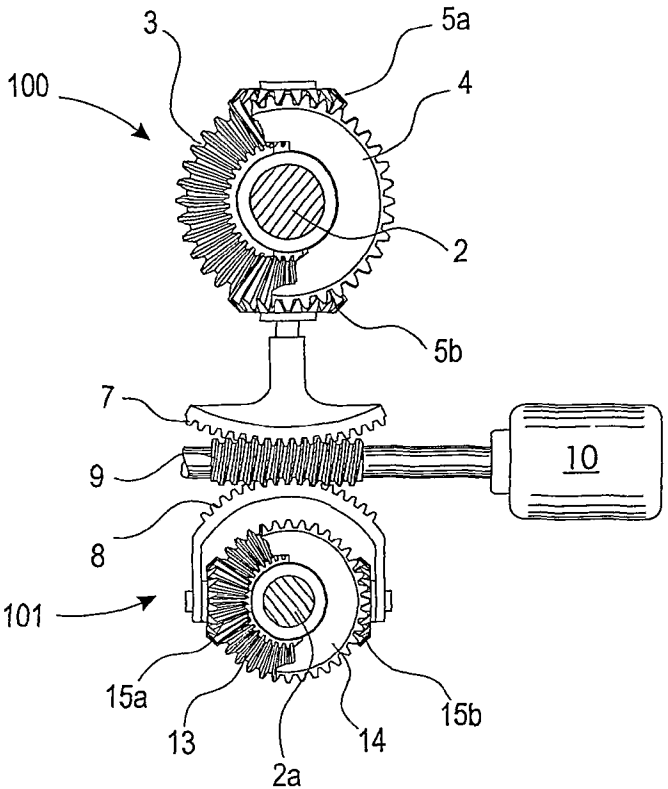
FIG. 3 is a side view of the phase altering arrangement of FIG. 2.
Figure 2:
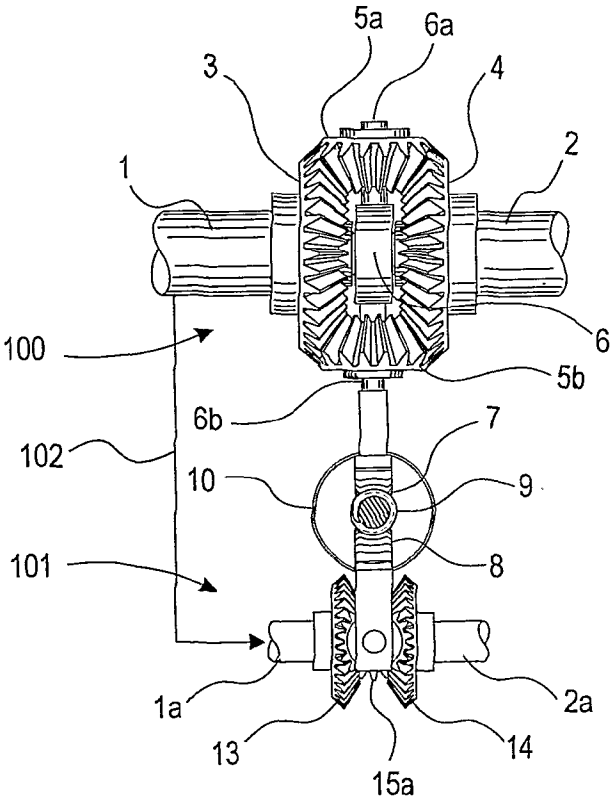
FIG. 2 is an enlarged side view of the phase altering arrangement.

With reference to FIGS. 2 and 3, the first phase altering mechanism 100 includes a first bevel gear 3 and a second bevel gear 4 mounted coaxially on the facing ends of center shaft 1 and center shaft 2 respectively. Intermediate bevel gears 5*a*, 5*b* interconnect said first bevel gear 3 and the said second bevel gear 4 for transmitting motion from the center shaft 1 to the center shaft 2. The axis of intermediate gears 5*a* and 5*b* intersects the axis of the center shafts. The intermediate bevel gears 5*a* and 5*b* are rotatable about coaxial shafts 6*a*, 6*b* extended radially from a hub 6 which is coaxially journaled on the center shaft 1. One of the shafts 6*b* is extended to connect a worm gear 7 operatively engaged to worm 9. The worm 9 is cross axially aligned to the axis of the hub 6. The worm 9 is connected to the motor 10 which is rotatable in either direction as required. With the rotation of the motor 10 the hub 6 along with intermediate bevel gears 5*a*, 5*b* alter their position about the center shaft axis and causing a relative phase alter between center shaft 1 and 2 by an angle twice of the angular shift of the hub 6 itself. The second phase altering mechanism 101 including an input shaft 1*a*, a discharge timing shaft 2*a*, a first bevel gear 13 and a second bevel gear 14 mounted on the facing ends of said input shafts 1*a* and the discharge timing shaft 2*a* respectively. Intermediate bevel gears 15*a*, 15*b* interconnect said bevel gears 13 and 14. Worm gear 8 is connected in meshing relation with said worm 9 for moving said intermediate bevel gears 15*a*, 15*b* about the common axis of shafts 1*a* and 2*a*, whereas the pitch circle radius of the worm gear 8 is half of the pitch circle radius of worm gear 7 of the first phase altering mechanism 100, hence, resulting two times more angular shift than the first phase altering mechanism 100. The input shaft 1*a* is preferably driven by center shaft 1 through a motion transmission link (schematically shown by arrow 102 in FIG. 2) at the same angular speed.

Though all the bevel gears are illustrated as strait tooth gears in the supporting figures, spiral bevel gears are preferable for practicing the invention.

Figure 4:
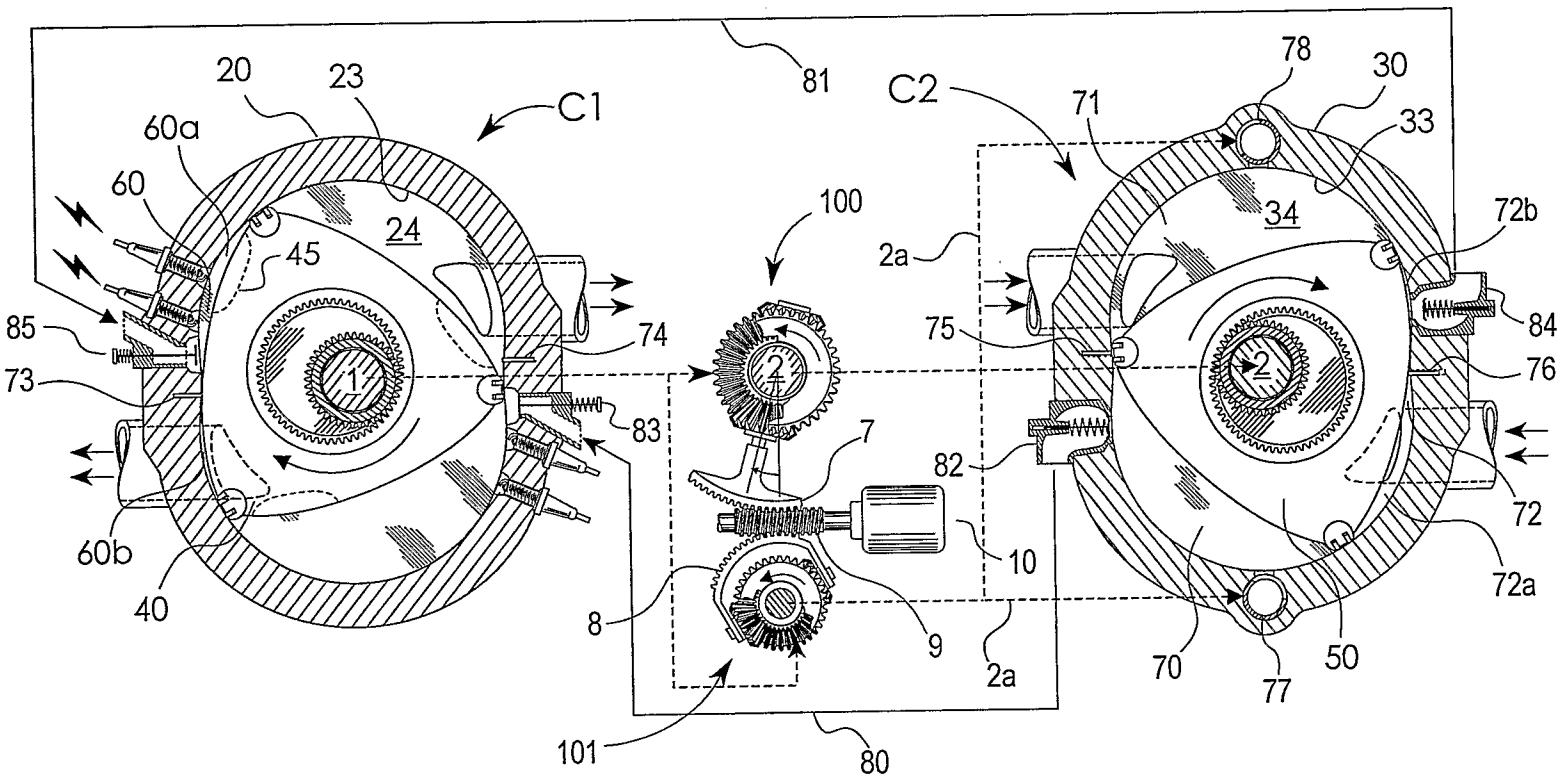
FIG. 4 is a schematic illustration of the engine during full-load operating condition.

With reference to FIG. 4, the figure illustrates full-load engine operating condition; wherein the motor 10 drive the worm 9 to turn the worm gear 7 by 15 degrees clockwise from its previous position as shown in FIG. 3 and simultaneously the worm gear 8 get turned counterclockwise by 30 degrees. Thereby the center shaft 2 gets relatively retarded by 30 degrees to the center shaft 1. Consequently the discharge timing shaft 2*a* gets relatively advanced by 60 degrees to input shaft 1*a*. Both the gas discharge valves 77 and 78 are operatively connected to discharge timing shaft 2*a*, hence, get relatively advanced to their respective working chambers by 90 CAD (the phase shifting directions between center shafts 1 and 2 is opposite to the phase shifting directions of input shafts 1*a* and discharge timing shaft 2*a*, which resulting in a total phase shift between center shaft 2 and discharge timing shaft 2*a* in this instance is 30 CAD+60 CAD=90 crank angle degrees), thereby kept open for the concluding 180 crank angle degree (CAD) of intake phases of corresponding working chambers and kept closed during the compression phases. Thereby the total amount of intake gas get effectively compressed and delivered to consecutive gas passages 80, 81. The divided trailing portion 72*b* of working chamber 72 shows a nearly concluding stage of a compression phase while the compressed gas is almost delivered to the corresponding gas passage 81 by displacing an equivalent amount of compressed gas which is delivered to corresponding combustion chamber defined by leading portion 60*a* of working chamber 60 plus recess 45. The outlet control valves 83, 85 and dividing seal arrangements 73, 74 are preferably driven by center shaft 1 and dividing seal arrangements 75, 76 are driven by center shaft 2 and attain one complete cycle during one complete turn of respective center shaft.

Figure 5:
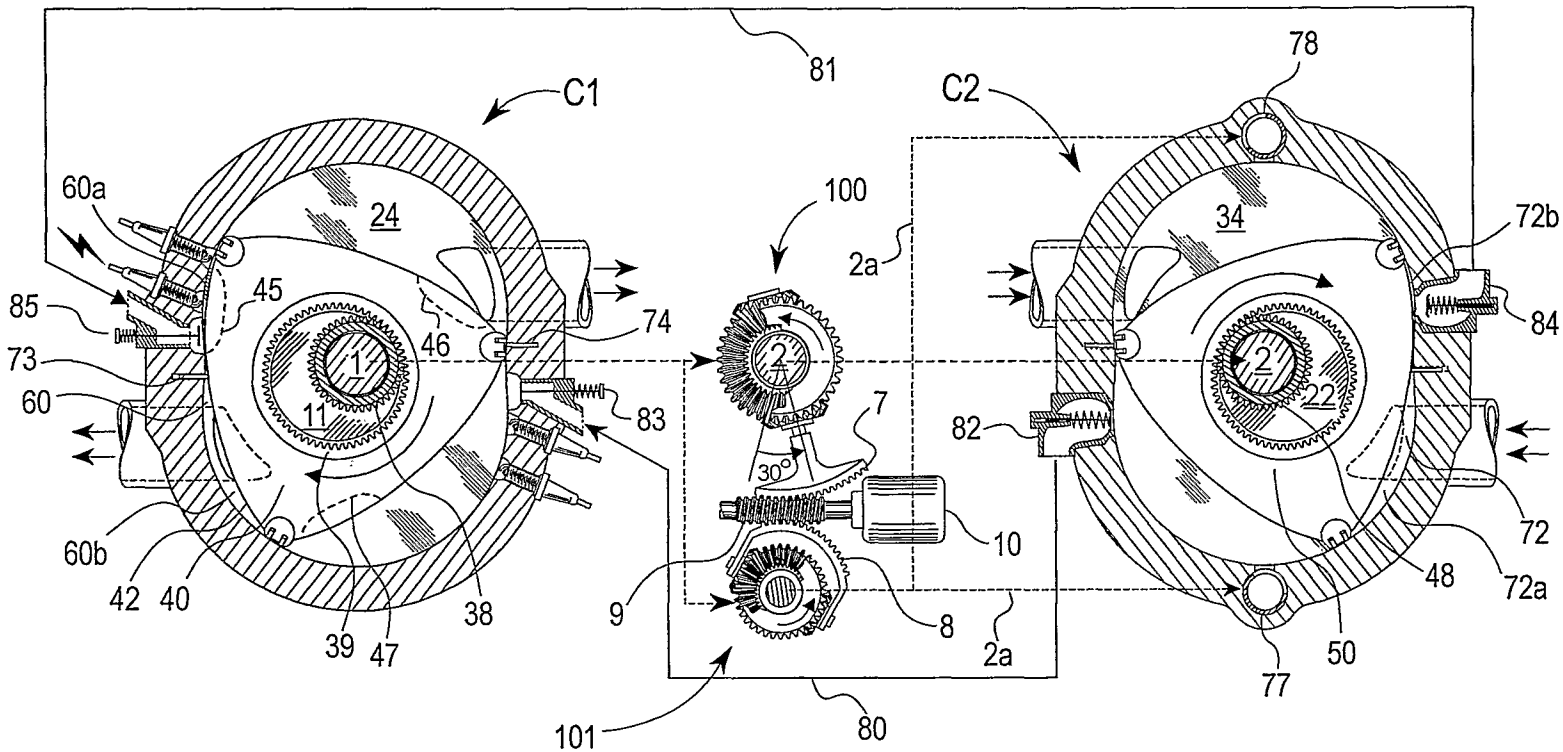
FIG. 5 is a schematic illustration of the engine during low-load operating condition.

With reference to FIG. 5, which illustrates low-load engine operating condition; wherein the worm gear 7 is driven to turn by 30 degrees counterclockwise and simultaneously the worm gear 8 get turned clockwise by 60 degrees from its previous position at full load operating condition as shown in FIG. 4. The rotor 50 of the second rotary configuration C2 gets relatively advanced by 60 CAD to the rotor 40 of the first rotary configuration C1 and the discharge timing shaft 2*a* and so the gas discharge valves 77, 78 get relatively retarded than its previously illustrated position (FIG. 4) by 120 degrees. Hence, the entire 180 degrees of opening period of said gas discharge valves 77, 78 now get shifted to connect their respective working chambers (70, 71 in this instance) during the early 180 CAD of compression phases. Nearly two third amount of total intake gases are discharged through gas discharge valves 77 and 78 and the remaining intake gases get compressed and delivered to corresponding gas passages 80, 81 through intake check valves 82 and 84. Opening of the outlet control valves 83 and 85 is arranged to coincide with the activation of dividing seal arrangements 73 and 74. The divided trailing portion 72*b* of working chamber 72 shows a nearly concluding stage of a compression phase while the volume of corresponding combustion chamber (volume of the leading portion 60*a* of divided working chamber 60 plus volume of the recess 45) is also nearly one third of the volume at full load conditions as shown in FIG. 4 (FIGS. 4 and 5 illustrate the state of combustion chambers during initiation of combustion), hence, nearly full-load-like combustion chamber pressure is attainable during low load driving conditions.

During the intermediate load conditions between the above stated full-load and low-load engine operating conditions the gas discharge valves 77 and 78 experience both the intake and compression phases for variable time ratios which vary upon engine load conditions. That is, while the engine is running at a load condition closer to low load condition larger portion of the opening period spent during compression phase and at a lode condition closer to full-load condition the larger portion of the valve opening period spent during intake phase. The discharged intake gases are recirculated to the successive intake chambers by a recirculation duct. The discharge valves provide additional intake aperture to intake chambers when open during intake phases.

During the period a dividing seal arrangement 73 (partially shown) of the first rotary configuration C1 is on, the leading portion of respective working face 42 of rotor 40 initially experiences the compressed gas pressure followed by combustion pressure, which exerts a substantially tangential force on said rotor 40. Though the center shaft 1 is still to turn by 30 degrees to reach TDC (as in the figure) the combustion chamber portion 60*a* is interestingly expanding in volume producing expansion work. The rotor 40 being pivoted by the phasing gears 38, 39 exerts a purely tangential force to the center shaft 1. In a conventional rotary engine (Wankel engine) or a reciprocating engine, on the contrary, a working chamber at 30 degrees BTDC represents a compression chamber; hence no work can be extracted.

Figure 6:
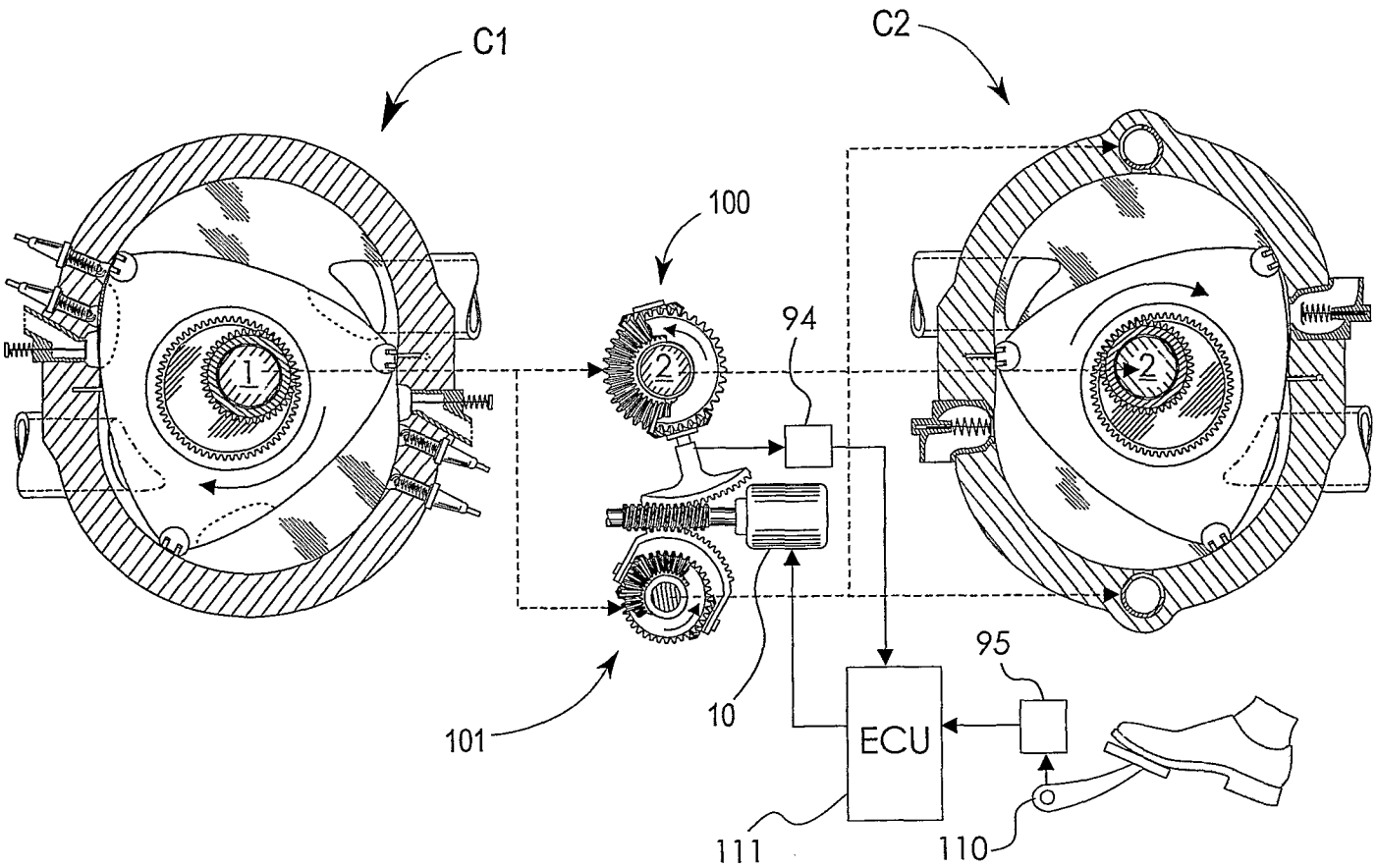
FIG. 6 is a schematic illustration of an embodiment of the invention in which an engine control microprocessor is used to control the phase altering arrangement based upon the position of a drive pedal.

With reference to FIG. 6, the motor 10, according to a preferred embodiment of the invention, is controlled by an engine control microprocessor 111 which uses information about the position of the drive pedal 110 to control said motor 10. The engine control microprocessor further uses information from a position detector 94 detecting the instantaneous state of phase altering mechanism 100 and the drive pedal position detector 95 and process them according to predetermined correlations to determine the instantaneous torque requirement of the motor 10.

Figure 7:
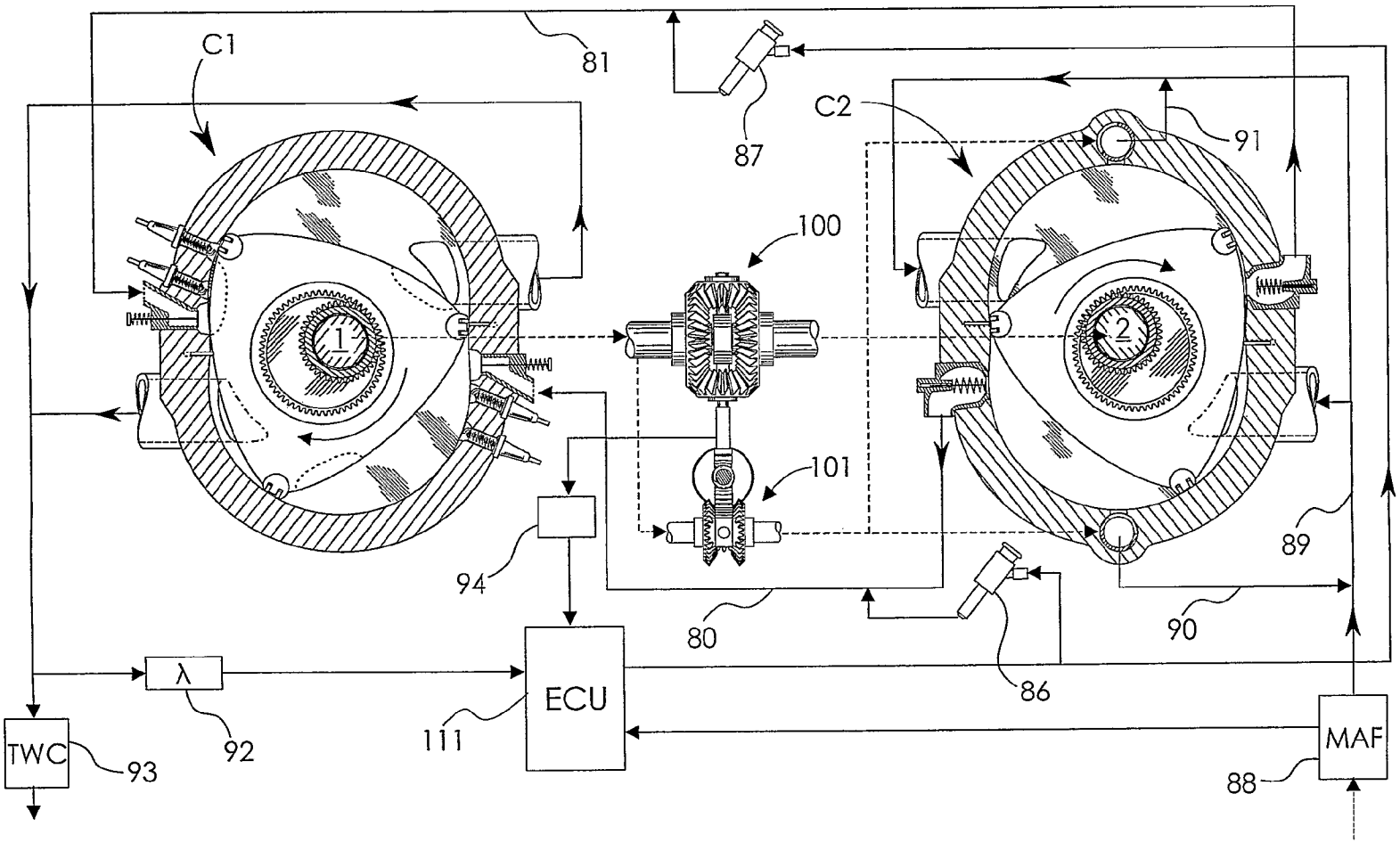
FIG. 7 is a schematic illustration of an embodiment of the invention in which a preferred fuel control scheme is shown.

With reference to FIG. 7, the gas passages 80, 81 are provided with high pressure fuel injectors 86, 87 [of the kind generally used for gasoline direct injection (GDI)]. The engine control microprocessor 111 controls the fuel injectors 86, 87 for maintaining the stoichiometric air fuel ratio by using combination of closed loop control using information from a mass airflow detector 88 and exhaust gas oxygen detector 92 and open loop control using predetermined correlations between the state of phase altering mechanism 100, engine speed and ambient air pressure. The unused intake gases which are discharged from the compression chambers of the second rotary configuration C2 are recirculated to the intake manifold 89 through recirculation ducts 90, 91, as it is highly desirable in order to preserve the reliability of mass airflow detector 88. The engine control microprocessor 111 further uses information about fuel line pressure to control the duration of fuel injection precisely.

Figure 8:
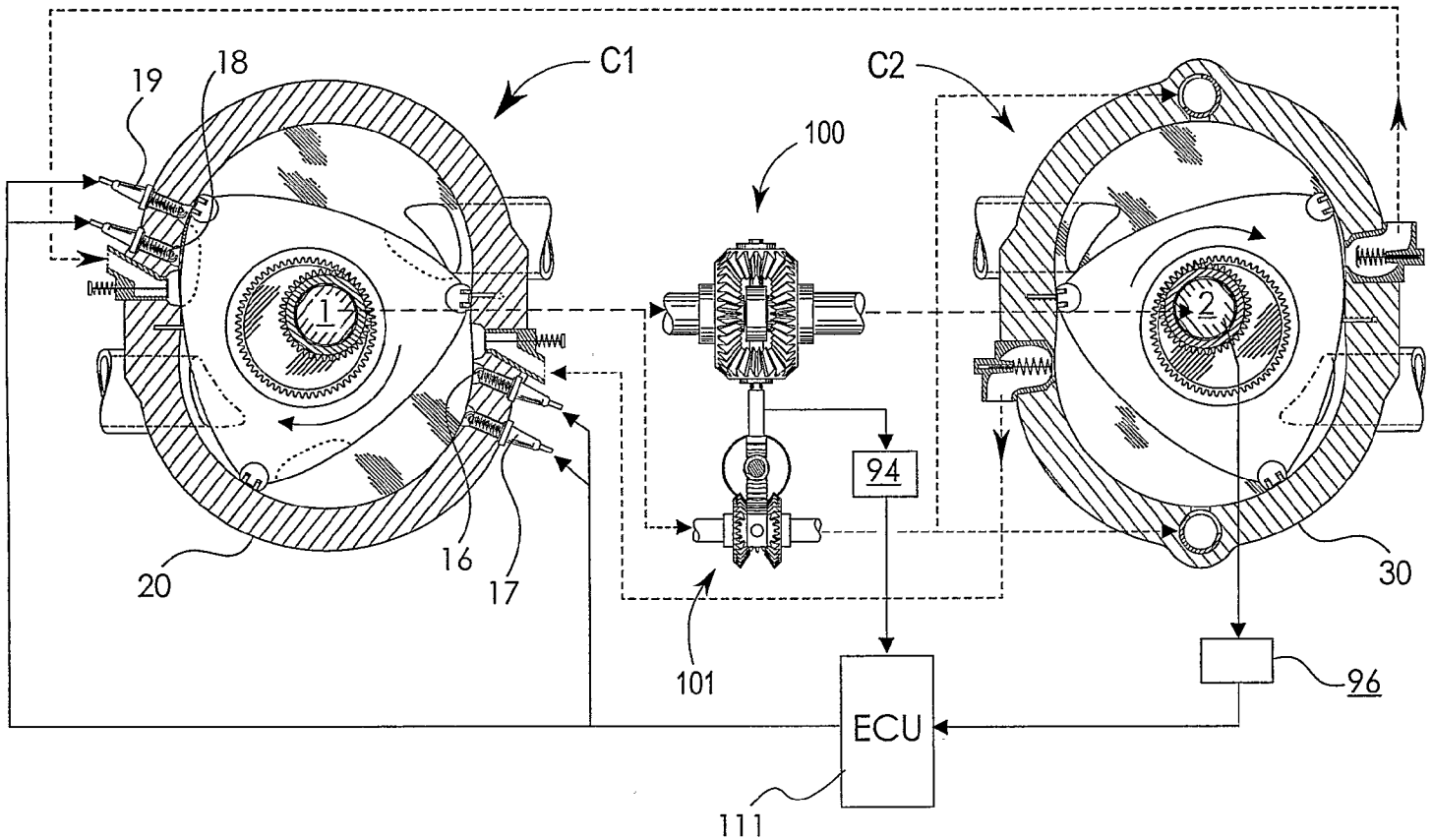
FIG. 8 is a schematic illustration of an embodiment of the invention in which a preferred ignition control scheme is shown.

With reference to FIG. 8, the engine control microprocessor 111 dictates the firing times to the pairs of sparkplugs 16, 17 and 18, 19 by using information from center shaft position detector 96 connected to center shaft 2. The engine control microprocessor 111 also uses information from the position detector 94 detects the state of the first phase altering mechanism 100 to determine the number of spark plugs to be fired at a time.

Figure 9:
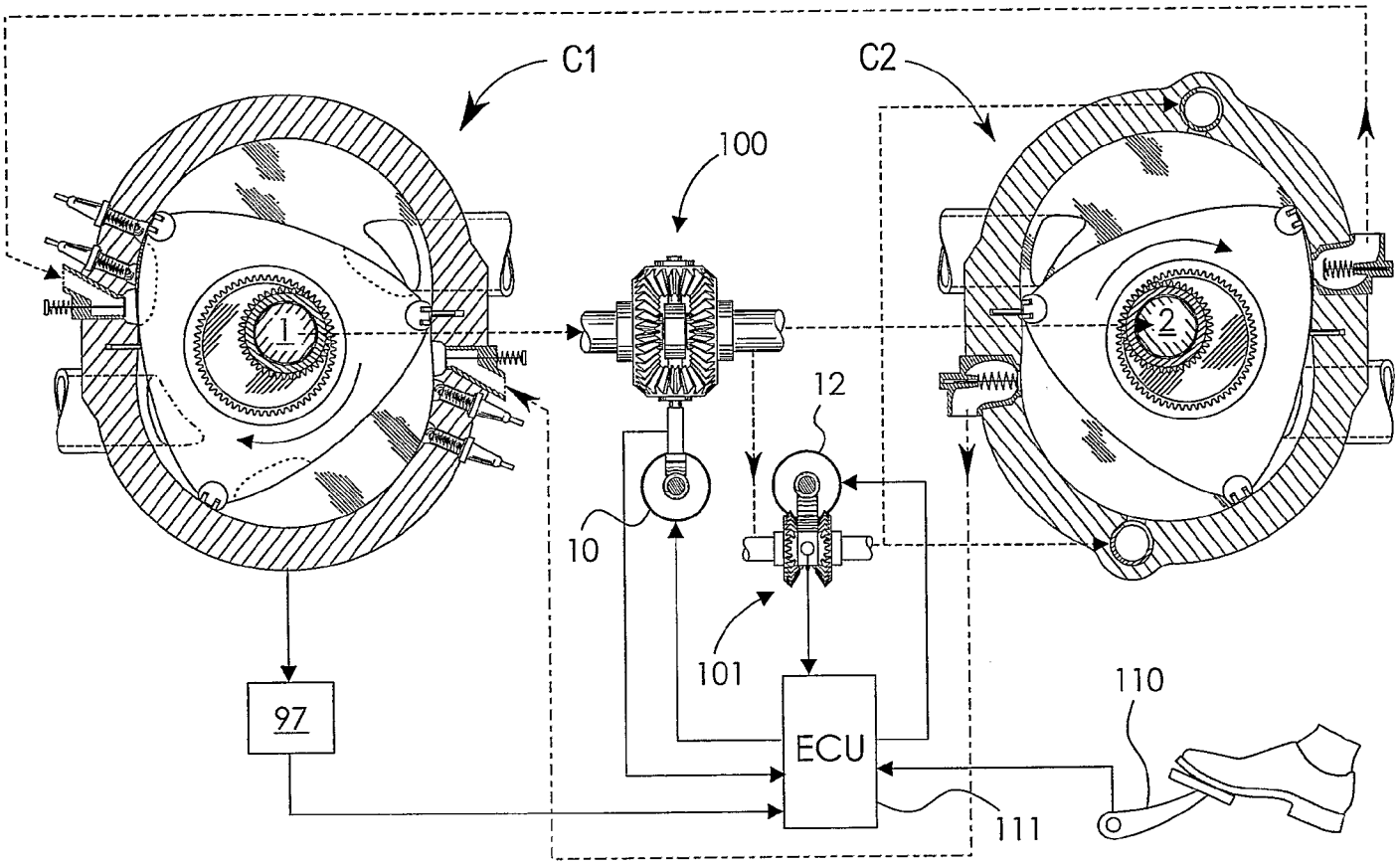
FIG. 9 is a schematic illustration of the most preferred alternative embodiment of the invention which has multi fuel compatibility.

FIG. 9 illustrates a highly preferred alternative embodiment of the invention in which the first phase altering mechanism 100 and the second phase altering mechanism 101 are driven by separate motors 10 and 12 respectively. Therefore, being free from the synchronized relation with the first phase altering mechanism 100, the second phase altering mechanism 101 is capable to vary both the displacement volume and compression ratio through a wide range. Thereby, the engine can shift readily and optimally through a wide variety of spark ignitable fuel. The gas discharge valves 77 and 78 of the second rotary configuration C2 are revised and repositioned to increase gas discharge capacity and so increasing the displacement variability of the engine. The engine control microprocessor 111 increases the compression ratio by using information from a knock detector 97.

Though the high pressure fuel injectors 86, 87 are most preferred for the present embodiment of the invention, it is also preferable to include low-pressure injectors for injecting fuel into the intake chambers of the second rotary configuration C2 during the intake phases. Port fuel injection system is also acceptable for the present embodiment of the invention.

As will be understood by those skilled in the applicable arts, various modifications and changes can be made in the invention and its particular form and construction without departing from the spirit and scope thereof. The embodiments disclosed herein are merely exemplary of the various modifications that the invention can take and the preferred practice thereof. It is not, however, desired to confine the invention to the exact construction and features shown and described herein, but it is desired to include all such as are properly within the scope and spirit of the invention disclosed and claimed.

What is claimed is:

1. A split-cycle variable capacity rotary spark ignition engine comprising: at least a first rotary configuration (C1) including plurality of repetitively volume variable working chambers adapted to carry out the combustion-expansion and exhaust phases of a four phase engine cycle; at least a second rotary configuration (C2) including plurality of repetitively volume variable working chambers adapted to carry out the intake and compression phases of a four phase engine cycle, wherein the working chambers of the first rotary configuration (C1) has sidewalls (24) with at least a first exhaust port (25) and at least a second exhaust port (26) and wherein the working chambers of the second rotary configuration (C2) has sidewalls (24) with at least a first intake port (35) and at least a second intake port (36); periodic seal means for periodically dividing each of successive working chambers into a volume expanding leading portion and a volume contracting trailing portion, corresponding to seal elements (73, 74) of the first rotary configuration (C1) and to seal elements (75, 76) of the second rotary configuration (C2); means for sequentially transferring compressed gases from the second rotary configuration (C2) to the first rotary configuration (C1), corresponding to gas passages (80, 81), inlet check valves (82, 84) of the second rotary configuration (C2) and outlet control valve arrangements (83, 85) of the first rotary configuration (C1); means for discharging variable fraction of trapped intake gas during compression phases, corresponding to gas discharge valves (77, 78) and a second phase altering mechanism (101); means for modifying phase relations between the first rotary configuration (C1) and the second rotary configuration (C2), corresponding to a first phase altering mechanism (100).

2. A split-cycle variable capacity rotary spark ignition engine which is operative through four phase engine cycle (intake, compression, combustion-expansion and exhaust phases), the engine comprising: at least a first rotary configuration (C1) including plurality of repetitively volume variable working chambers adapted to carry out the combustion-expansion and exhaust phases of a four phase engine cycle, wherein the working chambers of the first rotary configuration (C1) has sidewalls (24) with at least a first exhaust port (25) and at least a second exhaust port (26); at least a second rotary configuration (C2) including plurality of repetitively volume variable working chambers adapted to carry out the intake and compression phases of a four phase engine cycle, wherein the working chambers of the second rotary configuration (C2) has sidewalls (34) with at least a first intake port (35) and at least a second intake port (36); means for periodically dividing each of successive working chambers for a predefined period into a volume expanding leading portion and a volume contracting trailing portion, corresponding to seal elements (73, 74) of the first rotary configuration (C1) and to seal elements (75, 76) of the second rotary configuration (C2); means for sequentially transferring compressed gases from the compression chambers of the second rotary configuration (C2) to the corresponding combustion-expansion chambers of the first rotary configuration; wherein said means for sequentially transferring compressed gas comprises gas passages (80, 81) including inlet check valves (82, 84) at their one end connecting the compression chambers of the second rotary configuration and outlet control valves (83, 85) at their other end connecting the corresponding combustion-expansion chambers of the first rotary configuration; fuel injectors (86, 87) for injecting fuel into the passage means (80, 81); means for modifying effective engine displacement by means of discharging variable fraction of trapped intake gas from the compression chambers; wherein said means for modifying effective engine displacement comprises discharge valve means (77, 78) for discharging said intake gas from compression chambers and valve control means (101) for altering phase relation between the valve means and corresponding compression chambers; phase modification means for altering phase relation between the first rotary configuration and the second rotary configuration; wherein said phase modification means and valve control means comprising a first phase altering mechanism (100) and a second phase altering mechanism (101) respectively and driving means (10) for driving both of said first and second phase altering mechanisms (100, 101); an engine control unit (111) including a microprocessor which controls the driving means (10) by using information about the position of a drive pedal (110).

3. A split-cycle variable capacity rotary spark ignition engine which is operative through four phase engine cycle (intake, compression, combustion-expansion and exhaust phases), the engine comprising: at least a first rotary configuration (C1) including plurality of repetitively volume variable working chambers adapted to carry out the combustion-expansion and exhaust phases of a four phase engine cycle; at least a second rotary configuration (C2) including plurality of repetitively volume variable working chambers adapted to carry out the intake and compression phases of a four phase engine cycle; said first rotary configuration (C1) comprises a rotor housing (20) and said second rotary configuration (C2) comprises a rotor housing (30); said rotor housing (20) having an inner chamber defined by a peripheral wall (23) and sidewalls (24); wherein a rotor (40) is operative within said inner chamber of said rotor housing (20); said rotor housing (30) having an inner chamber defined by a peripheral wall (33) and sidewalls (34); wherein a rotor (50) is operative within said inner chamber of said rotor housing (30); said sidewalls (24) comprise a first exhaust port 25 connected to a first exhaust manifold (25a) and a second exhaust port (26) connected to a second exhaust manifold (26*a*); said sidewalls (34) comprise a first intake port (35) connected to a first intake manifold (35*a*) and a second intake port (36) connected to a second intake manifold (36*a*); each of the rotors (40, 50) have two sides and plurality of apex portions; working faces (42, 43, 44 of rotor 40 and 52, 53, 54 of rotor 50) of the rotors are extended between each pair of adjacent apex portions; both the rotors are rotatable about an individual lobe (11, 22) eccentrically integrated with respective center shaft (1, 2); the center shafts (1, 2) are rotatable about their own axis and fitted coaxially on respective rotor housings (20, 30); internal ring gears (39, 49) are confined coaxially on both side of the rotors (40, 50) to be operatively engaged in meshing relation with corresponding external ring gears (38, 48) confined coaxially on the facing sidewalls (24, 34) of the respective rotor housings; each working chamber is surrounded by a seal grid comprising apex seal arrangements (41) carried by the apex portions of the rotors and side seal arrangements (64) carried by both sides of the rotor; dividing seal means for periodically dividing each of successive working chambers for a predefined period, corresponding to seal elements (73, 74) of the first rotary configuration (C1) and seal elements (75, 76) of the second rotary configuration (C2); gas transfer means for sequentially transferring compressed gas from the compression chambers of the second rotary configuration (C2) to the corresponding combustion-expansion chambers of the first rotary configuration (C1); wherein said gas transfer means comprises passage means (80, 81) including inlet check valves (82, 84) at their one ends connecting compression chambers of second rotary configuration (C2) and outlet control valves (83, 85) at the other ends connecting the corresponding combustion-expansion chambers of the first rotary configuration (C1); fuel injection means for injecting fuel into said passage means corresponding to (86, 87); ignition means for initiating ignition within the leading portions of divided working chambers of the first rotary configuration (C1), corresponding to pairs of spark plugs (16, 17 and 18, 19); gas discharge valve means for discharging variable fraction of trapped intake gas from the compression chambers, corresponding to (77, 78); valve control means for controlling said gas discharge valve means, corresponding to a second phase altering mechanism (101); phase modification means for altering phase relation between the first rotary configuration and the second rotary configuration; wherein said phase modification means comprising a first phase altering mechanism (100) and a first driving means (10) for driving said first phase altering mechanism (100); wherein said valve control means comprising a second phase altering mechanism (101) and a second driving means (12) for driving said second phase altering mechanism (101); an engine control unit (111) including a microprocessor which controls the said first driving means (10) and said second driving means (12); and wherein the engine control microprocessor uses information about the position of a drive pedal (110) for controlling said driving means (10, 12); and wherein said microprocessor (111) further controls the fuel injection means (86, 87) for injecting fuel and ignition means for initiating ignition.

4. The split-cycle variable capacity rotary internal combustion engine as claimed in claim 3, wherein the apex seal arrangements comprise swivel apex seal arrangements (41).

5. The split-cycle variable capacity rotary internal combustion engine as claimed in claim 3, wherein recesses (45, 46, 47) are provided on the leading portion of each working faces (42, 43, 44) of the rotor (40) of the first rotary configuration (C1).

6. The split-cycle variable capacity rotary internal combustion engine as claimed in claim 3, wherein the fractions of trapped intake gases which are discharged from the compression chambers are recirculated to the successive intake chambers through recirculation ducts (90, 91).

7. The split-cycle variable capacity rotary internal combustion engine as claimed in claim 3, wherein said engine control microprocessor (111) for controlling the fuel injection means (86, 87) uses a combination of closed loop control using information from a mass airflow detector (88) and an exhaust gas oxygen detector (92) and open loop control using predetermined correlations between the state of phase altering mechanisms (100, 101), engine speed and ambient air pressure.

* * * * *

UNITED STATES PATENT AND TRADEMARK OFFICE

CERTIFICATE OF CORRECTION

PATENT NO. : 8,671,907 B2
APPLICATION NO. : 12/594913
DATED : March 18, 2014
INVENTOR(S) : Jiban Jyoti Mistry It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1138 days.

Signed and Sealed this
Twenty-ninth Day of September, 2015

Michelle K. Lee

Michelle K. Lee
*Director of the United States Patent and Trademark Office*